United States Patent [19]

Girodi et al.

[11] 4,309,193

[45] Jan. 5, 1982

[54] APPARATUS FOR INPUT AND DISTRIBUTION OF GASIFICATION MEDIUM IN A ROTARY GRID GENERATOR

[75] Inventors: Erich Girodi, Hoyerswerda; Gerhard Richter, Spremberg; Berthold Neumann, Hoyerswerda; Peter Jaschke, Ossling; Johannes Slabik, Hoyerswerda; Roland Weber, Hoyerswerda; Andrea Schmidt, Hoyerswerda; Peter Krieg, Hoyerswerda; Lutz Gröschel, Hoyerswerda; Joachim Heynisch, Tschernitz; Joachim Starke, Hoyerswerda; Dietrich Wienold, Hornow; Günter Scholz; Eckehard Mönch, both of Hoyerswerda, all of German Democratic Rep.

[73] Assignee: VEB Gaskombinat Schwarze Pumpe, Schwarze Pumpe, German Democratic Rep.

[21] Appl. No.: 104,907

[22] Filed: Dec. 18, 1979

[51] Int. Cl.[3] ..... C10J 3/72

[52] U.S. Cl. ..... 48/66; 48/87; 110/288; 110/300; 126/152 B; 126/163 R; 126/182; 239/397.5

[58] Field of Search ..... 48/66, 68, 87; 266/279; 110/247, 298, 300, 288, 275; 126/181, 182, 152 B, 163 A, 163 R; 239/397.5

[56] References Cited

U.S. PATENT DOCUMENTS

| | | | |
|---|---|---|---|
| 1,172,070 | 2/1916 | Steelman | 48/66 |
| 1,520,539 | 12/1924 | Duckett | 48/66 |
| 1,913,088 | 6/1933 | Ridgely | 110/275 |
| 2,001,274 | 5/1935 | Haug | 48/66 |
| 2,183,596 | 12/1939 | Trinks | 239/397.5 |
| 3,937,620 | 2/1976 | Rudolph et al. | 48/68 |

*Primary Examiner*—S. Leon Bashore
*Assistant Examiner*—Michael L. Goldman
*Attorney, Agent, or Firm*—Michael J. Striker

[57] ABSTRACT

The invention discloses an apparatus for maximizing the uniformity of distribution of gasification medium in a rotary grid generator. To insure proper input, a distribution head is rotatably mounted within the interior of the rotary grid, and the distribution head is connected by means of elastic input conduits to either openings which are directly connected with the reactor chamber, or to distribution chambers in the individual segments of the rotary grid. Through use of the apparatus, the formation of canals through preferential gas flow in the solid beds of pressure gas generators is eliminated.

4 Claims, 1 Drawing Figure

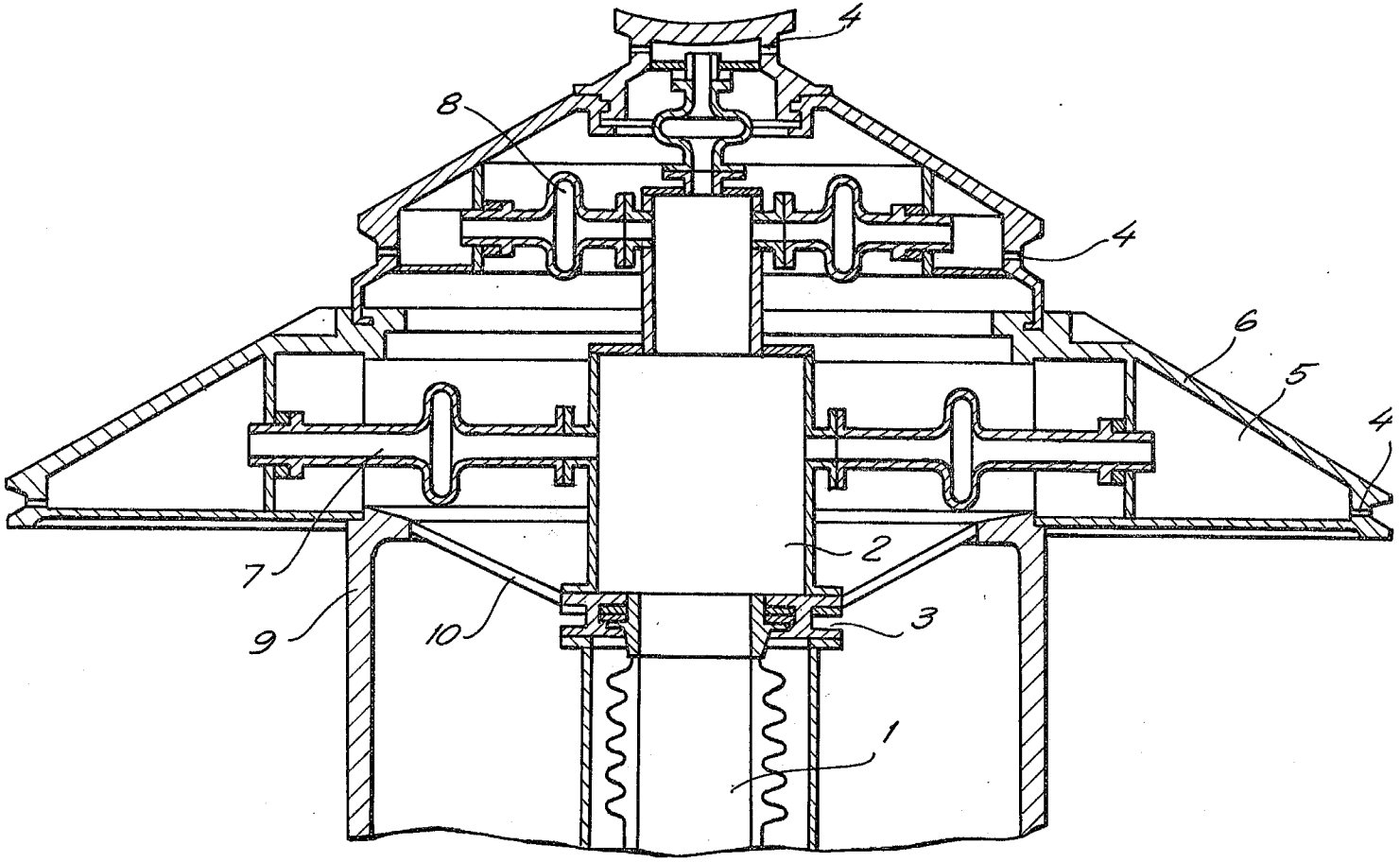
4
5
6
4
4
3
2
1
8
10
7
9

APPARATUS FOR INPUT AND DISTRIBUTION OF GASIFICATION MEDIUM IN A ROTARY GRID GENERATOR

BACKGROUND OF THE INVENTION

The invention is generally applicable in the field of gas generation, where a gasification medium is introduced into the process through a rotary grid. The invention finds particular applicability in solid bed pressure generators.

The introduction of material to be reacted in rotary grid generators as a rule is carried out through the rotary grid which simultaneously serves as means for removal of ash in the reacting fuel layer. This rotary grid is as a rule a conical or cone-shaped hollow body of heat-resistant cast steel, to which the fuel is introduced over one or more centrally-arranged input conduits or pipes. The fuel then enters the reaction chamber through openings in the conical surface of the grid. In large reactors, and in particular in pressure gas generators, in which for insertion of the grid into the reactor only comparatively small openings with respect to the reactor diameter are present, annular segments in multiple levels form the grid. For optimal operation of the process system through a uniform distribution of the gasification medium through the openings in the surface of the grid it is necessary that the hollow body formed from the annular segments remain sealed at the butt-joints, so that no uncontrolled gasification medium input occur at these, which would negatively influence the efficiency of the reaction. On account of the high thermal and mechanical charging of the rotary grids, they are generally subjected to deformations of the segments, so that gaps form at the joints through which the gasification med. can pass.

As the uniform distribution of gasification medium in high-capacity generators is obtained through the force of high pressure differences between the grid interior and the reactor, already with the small gaps as may develop in the assembly the distribution is disturbed. Through this the distribution of the gasification medium is not longer uniform over the reactor cross section, leading to significant disturbances in operation of the generator which can only be overcome through replacement of the rotary grid. Complicated methods have been devised accordingly for sealing of the segments, yet these have not proved sufficient over extended operation periods.

It has further been suggested, for example according to DD-WP C 10j/198 286, to minimize the heat sensitivity of the rotary grid through protective coatings of fireproof material so that there is no deformation of the segments. In addition to the negative effect on ash removal on account of the altered coefficient of friction between ash and rotary grid, these protective coatings are also ineffective after extended contact with very hot ash, as on the inner side of the rotary grid, on account of the large hollow chamber, such low speeds of the gasification medium and thus low heat transfer coefficients are obtained, that there is hardly any difference in the thermal sensitivity of the rotary grid over time.

DESCRIPTION OF THE INVENTION

The invention is directed to the achievement of a uniform distribution of gasification medium in the solid bed, the prevention of the formation of canals through preferential gas flow within the solid bed and an increase in the performance of the gas generator.

The invention attempts to direct the flow of the gasification medium through the rotary grid in such a manner, that even when there are deformations of the rotary grid the exit of the gasification medium occurs only at the desired locations, and the disadvantages of the prior art devices thus overcome. Thereby it is possible to minimize operational difficulties and to increase the operations life of the rotary grids.

The above objects are achieved by arranging a rotatably pivoted gasification medium distribution head, which is connected via elastic input conduits directly with openings for gasification medium introduction or with distributor chambers in each of the individual segments.

For sealing between the distributor head and the input conduit for the gasification medium a seal or joint is arranged, which is so formed, that with increasing radial forces and movement the seal is nonetheless guaranteed.

The gasification medium enters the distributor head through the central input conduit and from this travels via the effectively elastic conduits either directly to the individual input opening or into the distribution chambers in the segments, out of which the gasification medium then enters the reaction chamber via corresponding openings.

This type of distribution of the gasification medium guarantees that the gasification medium is conveyed only to the desired locations in the solid bed from the rotary grid, and the formation of canals through preferential gas flow with all of the associated disadvantages is eliminated. Thereby as well as separation of the double function of the grid as gasification medium distributor and discharge means is effected.

The assembly or mounting of the apparatus can be carried out quite easily with the assembly of the grid inside the reactors.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The sole FIGURE illustrates a section through the inventive rotary grid gate.

DESCRIPTION OF PREFERRED EMBODIMENT

The invention may be better understood through the drawing of an embodiment of the inventive apparatus. On the input conduit 1 for the gasification medium the distribution head 2 is rotatably arranged. The sealing of the distribution head 2 with the input conduit 1 is carried out through a seal or joint 3. As can be seen from the drawing, the rotary grid has three hollows arranged one after the other in an axial direction. The lower and intermediate hollows in the drawings have distributing chambers 5 and openings 4, whereas the upper hollow has only the openings 4. The input of the gasification medium to the openings 4 or the distribution chambers 5 of the rotary grid segments 6 is effected through the input conduits 7, in which to improve the elasticity a bellows device 8 is inserted. For mounting purposes the connection of the input conduits 7 with the openings 4 and/or the distribution chambers 5 is made releasable. Also releasable is the combination with the distribution head 2. For release of tension on the input conduits 7, the distribution head 2 is combined with the main shaft 9 by means of cross pieces 10 for transfer of the rotational moment in order to overcome friction in seal 3.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An apparatus for distribution of gasification medium in a rotary grid generator comprising a rotary grid which has an axis and forms at least two axially spaced hollows one of which is subdivided into a plurality of circumferentially arranged distributing chambers provided with a first group of openings which communicate the interior of the one hollow with the exterior of the rotary grid through the distributing chambers, whereas the other of said hollows is provided with a second group of openings which communicate the interior of the other hollow with the exterior of the rotary grid directly, a rotatable distribution head having an inlet for admitting gasification medium and a plurality of outlets for exiting the same, and a plurality of circumferentially spaced conduit members each having an inlet end communicating with a respective one of said outlets of said distribution head, and an outlet end communicating with a respective one of the distributing chambers of the one hollow of the rotary grid or with the other hollow of the latter, each of said conduit members having an elastic bellows-shaped portion arranged between the inlet end of the outlet end thereof.

2. An apparatus as defined in claim 1, wherein the rotary grid is provided with a structural support for the same; and further comprising means for connecting said distribution head with and supporting the same on the structural support.

3. An apparatus as defined in claim 2, wherein said connecting and supporting means includes a plurality of cross bars attaching said distribution head to the structural support.

4. A gasification apparatus comprising a gasification generator and a rotary grid in said generator which has an axis and forms at least two axially spaced hollows one of which is subdivided into a plurality of circumferentially arranged distributing chambers provided with a first group of openings which communicate the interior of the one hollow with the exterior of said rotary grid through the distributing chambers, whereas the other of said hollows is provided with a second group of openings which communicate the interior of said other hollow with the exterior of said rotary grid directly; and an apparatus for distributing gasification medium having a rotatable distribution head with an inlet for admitting gasification medium and a plurality of outlets for exiting the same, and a plurality of circumferentially spaced conduit members each having an inlet end communicating with a respective one of said outlets of said distribution head, and an outlet end communicating with a respective one of said distributing chambers of said one hollow of said rotary grid or with said other hollow of the latter, each of said conduit members having an elastic bellows-shaped portion arranged between the inlet end and the outlet end thereof.

* * * * *